US012571597B2

(12) United States Patent
Inagaki et al.

(10) Patent No.: US 12,571,597 B2
(45) Date of Patent: Mar. 10, 2026

(54) HEAT SINK WITH FLATTENED HEAT PIPES

(71) Applicant: Furukawa Electric Co., Ltd., Tokyo (JP)

(72) Inventors: Yoshikatsu Inagaki, Tokyo (JP); Yasuhiro Uchimura, Tokyo (JP); Shuta Hikichi, Tokyo (JP); Tatsuro Miura, Tokyo (JP); Hiroshi Sakai, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 113 days.

(21) Appl. No.: 17/039,658

(22) Filed: Sep. 30, 2020

(65) Prior Publication Data

US 2021/0018272 A1 Jan. 21, 2021

Related U.S. Application Data

(63) Continuation of application No. PCT/JP2019/048615, filed on Dec. 12, 2019.

(30) Foreign Application Priority Data

Dec. 28, 2018 (JP) ..... 2018-247479

(51) Int. Cl.
*F28D 15/02* (2006.01)
*F28D 15/04* (2006.01)

(52) U.S. Cl.
CPC ..... *F28D 15/0233* (2013.01); *F28D 15/0275* (2013.01); *F28D 15/046* (2013.01)

(58) Field of Classification Search
CPC . F28D 15/0233; F28D 15/0275; F28D 15/046
See application file for complete search history.

(56) References Cited

U.S. PATENT DOCUMENTS 7,128,131 B2 * 10/2006 Kubo ..... H01L 23/3672 165/185
9,188,396 B2 11/2015 Kameoka et al.
(Continued)

FOREIGN PATENT DOCUMENTS

CN 102034774 A 4/2011
CN 106767071 A 5/2017
(Continued)

OTHER PUBLICATIONS

English translation of Notice of Reasons for Refusal received in JP 2018-247479 dated Jun. 17, 2019.
(Continued)

*Primary Examiner* — Travis Ruby
(74) *Attorney, Agent, or Firm* — Dorsey & Whitney LLP

(57) ABSTRACT

A heat sink includes a plurality of heat pipes to be thermally connected to a heating element, and a heat dissipation section thermally connected to the plurality of heat pipes, in which in the plurality of heat pipes, at least evaporation sections to be thermally connected to the heating element have flattened portions whose cross sectional shape in a direction orthogonal to a heat transfer direction of the plurality of heat pipes is flattened, and surfaces in the flattened portions in a thickness direction are arranged facing the heating element.

17 Claims, 5 Drawing Sheets

(56) References Cited

U.S. PATENT DOCUMENTS

| | | | | |
|---|---|---|---|---|
| 10,408,547 | B2 | 9/2019 | Kameoka et al. | |
| 2005/0263265 | A1* | 12/2005 | Sheng | F28D 15/0275 165/104.21 |
| 2005/0274495 | A1* | 12/2005 | Wang | F28D 15/0283 165/104.26 |
| 2007/0095510 | A1* | 5/2007 | Lin | H01L 23/427 257/E23.103 |
| 2007/0279909 | A1* | 12/2007 | Li | F28D 15/0266 362/294 |
| 2008/0047139 | A1* | 2/2008 | Hsu | B23P 15/26 29/890.038 |
| 2009/0139696 | A1* | 6/2009 | Shih | F28F 1/022 165/104.26 |
| 2010/0270007 | A1 | 10/2010 | Lin | |
| 2011/0080711 | A1 | 4/2011 | Kicin et al. | |
| 2011/0192026 | A1* | 8/2011 | Chen | B23P 11/00 29/890.03 |
| 2012/0048517 | A1 | 3/2012 | Huang et al. | |
| 2012/0118537 | A1* | 5/2012 | Kameoka | F28D 15/046 29/890.032 |
| 2012/0216991 | A1* | 8/2012 | Chen | F28D 15/0233 29/890.032 |
| 2012/0312508 | A1 | 12/2012 | Shen | |
| 2013/0020055 | A1* | 1/2013 | Wu | F28F 13/00 29/428 |
| 2013/0037242 | A1 | 2/2013 | Chen et al. | |
| 2013/0213612 | A1 | 8/2013 | Wu | |
| 2014/0138056 | A1* | 5/2014 | Horng | F28F 3/048 165/104.21 |
| 2014/0166244 | A1 | 6/2014 | Dai et al. | |
| 2015/0219400 | A1* | 8/2015 | Sasaki | H01L 23/427 165/104.26 |
| 2016/0209121 | A1* | 7/2016 | Yeh | F28D 15/0275 |
| 2016/0282054 | A1* | 9/2016 | Hirasawa | H01L 23/3736 |
| 2020/0141659 | A1 | 5/2020 | Inagaki et al. | |

FOREIGN PATENT DOCUMENTS

| | | | |
|---|---|---|---|
| EP | 2728614 | A1 | 5/2014 |
| JP | 2003110072 | A | 4/2003 |
| JP | 3164517 | U | 11/2010 |
| JP | 2012154622 | A | 8/2012 |
| JP | 2013002640 | A | 1/2013 |
| JP | 2013195001 | A | 9/2013 |
| TW | I394927 | B | 5/2013 |
| WO | 2018235936 | A1 | 12/2018 |

OTHER PUBLICATIONS

English Translation of Office Action received in TW App. No. 108147553 dated Jun. 20, 2020.

International Search Report and Written Opinion received in PCT App. No. PCT/JP2019/048615 dated Jan. 28, 2020 (Engl. trans of ISR only).

English Translation of International Preliminary Report on Patentability for Application No. PCT/JP2019/048615, dated Jun. 16, 2021.

English Translation of Written Opinion for Application No. PCT/JP2019/048615, dated Jan. 28, 2020.

* cited by examiner

HEAT SINK WITH FLATTENED HEAT PIPES

CROSS REFERENCE TO RELATED APPLICATIONS

The present application is a continuation application of International Patent Application No. PCT/JP2019/048615 filed on Dec. 12, 2019, which claims the benefit of Japanese Patent Application No. 2018-247479, filed on Dec. 28, 2018. The contents of these applications are incorporated herein by reference in their entirety.

BACKGROUND

Technical Field

The present disclosure is related to a heat sink configured to cool a heating element set as a cooling target by transferring heat of the heating element to a heat dissipation section by using a heat transfer function of a heat pipe.

BACKGROUND

Along with an enhancement of functions of an electronic device in recent years, a large number of parts including a heating element such as an electronic part have been mounted inside the electronic device at a higher density than ever. In addition, along with the enhancement of the functions of the electronic device, an amount of heat generated by the heating element such as the electronic part has increased more than ever. As a unit configured to cool the heating element such as the electronic part, a heat sink is used in some cases. To reliably and also efficiently cool even a heating element generating a high amount of heat, a heat sink where a plurality of heat pipes are thermally connected to the heating element is used in some cases.

As the heat sink where the plurality of heat pipes are thermally connected to the heating element, for example, a heat sink exists where a large number of flat plate-like heat dissipation fins protruding to outer peripheral surfaces of a plurality of tubular heat pipes are disposed (Japanese Patent Laid-Open No. 2003-110072). The heat sink of Japanese Patent Laid-Open No. 2003-110072 is a heat sink formed in a manner that heat of the heating element is transferred to the heat dissipation fins by the plurality of tubular heat pipes, and the heat is to be dissipated from the heat dissipation fins.

In a heat sink where the heat of the heating element is transferred from a heat reception section to the heat dissipation fins by the plurality of heat pipes such as the heat sink of Japanese Patent Laid-Open No. 2003-110072, to exhibit a cooling property for even a heating element generating a high amount of heat, it is necessary to form a heat pipe group where a large number of heat pipes are arranged in parallel, and thermally connect the heat pipe group to the heating element. On the other hand, to thermally connect the heat pipe group formed by the large number of heat pipes to the heating element, it is necessary to secure a large space for housing the heat pipe group inside the electronic device. However, since a large number of parts are mounted inside the electronic device at the higher density than ever, the heating element may also be mounted into an even narrowed space in some cases.

Because of a constraint of the space inside the electronic device as described above, the number of installed heat pipes forming the heat pipe group may be restricted in some cases. When the number of installed heat pipes is restricted, the cooling property for the heating element generating a high amount of heat may not be sufficiently applied to the heat sink in some cases.

SUMMARY

The present disclosure is related to providing a heat sink that can exhibit an excellent cooling property for even a heating element generating a high amount of heat and being mounted into a narrowed space.

A gist of the configuration of the present disclosure is as follows.

[1] A heat sink including a plurality of heat pipes to be thermally connected to a heating element, and a heat dissipation section thermally connected to the plurality of heat pipes, in which in the plurality of heat pipes, at least evaporation sections to be thermally connected to the heating element have flattened portions whose cross sectional shape in a direction orthogonal to a heat transfer direction of the plurality of heat pipes is flattened, and surfaces in the flattened portions in a thickness direction are arranged facing the heating element.

[2] The heat sink as described in [1], in which the evaporation section of the heat pipe is located in one end portion of the heat pipe, and a condensation section of the heat pipe to be thermally connected to the heat dissipation section is located in another end portion of the heat pipe.

[3] The heat sink as described in [1], in which the evaporation section of the heat pipe is located in a central portion of the heat pipe, and the condensation section of the heat pipe to be thermally connected to the heat dissipation section is located in both end portions of the heat pipe.

[4] The heat sink as described in any one of [1] to [3], in which the evaporation sections of the plurality of heat pipes are arranged in parallel along an extending direction of the heating element.

[5] The heat sink as described in any one of [1] to [4], in which the evaporation section of the heat pipe is thermally connected to a heat reception plate, and the heat reception plate is to be thermally connected to the heating element.

[6] The heat sink as described in any one of [1] to [5], in which the flattened portion extends from the evaporation section to the condensation section.

[7] The heat sink as described in any one of [1] to [6], in which the heat pipe includes a first wick structure corresponding to fine grooves formed on an inner surface of a container, and a second wick structure having protrusion portions protruding from the inner surface of the container in flat segments forming a main surface of the flattened portion.

[8] The heat sink as described in [7], in which the heat pipe further includes a third wick structure disposed in a layered manner on an inner surface of the flattened portion in the thickness direction.

In accordance with a mode of the heat sink of the present disclosure, since at least the evaporation section in the heat pipe has the flattened portion whose cross sectional shape in the direction orthogonal to the heat transfer direction of the heat pipe is flattened and the surface in the flattened portion in a thickness direction is arranged facing the heating element, an increased number of heat pipes can be thermally connected to the heating element set as the cooling target without increasing an installment space of the heat reception section of the heat sink. In addition, in accordance with a mode of the heat sink of the present disclosure, an increased number of heat pipes can be thermally connected to the heat dissipation section of the heat sink. Therefore, in accordance with a mode of the heat sink of the present disclosure, a heat dissipation efficiency of the heat dissipation section improves, and the excellent cooling property can be exhibited for the heating element even having the high heat value mounted into the narrowed space.

In accordance with a mode of the heat sink of the present disclosure, since the one end portions or central portions of the plurality of heat pipes are arranged in parallel along the extending direction of the heating element, the plurality of heat pipes can be reliably and also easily thermally connected to the heating element.

In accordance with a mode of the heat sink of the present disclosure, since the one end portion or central portion of the heat pipe is thermally connected to the heat reception plate, a thermal connectivity between the heat pipe and the heating element improves. In addition, the heat reception plate also has an action as a heat equalizing plate configured to equalize thermal loads to the respective heat pipes arranged in parallel, and can more reliably exhibit heat transfer properties of the respective heat pipes.

In accordance with a mode of the heat sink of the present disclosure, since the heat pipe includes the first wick structure corresponding to the fine grooves formed on the inner surface of the container and the second wick structure having the protrusion portions protruding from the inner surface of the container in the flat segments forming the main surface of the flattened portion, a liquid working fluid can be smoothly recirculated to the flattened portion. Thus, even the heat pipe having the flattened portion in the evaporation section can exhibit the excellent heat transfer property.

In accordance with a mode of the heat sink of the present disclosure, since the heat pipe further includes the third wick structure disposed in the layered manner on the inner surface of the flattened section in the thickness direction, the liquid working fluid can be more smoothly recirculated to the flattened portion. Thus, even the heat pipe having the flattened portion in the evaporation section can exhibit the more excellent heat transfer property.

DETAILED DESCRIPTION

Figure 1:
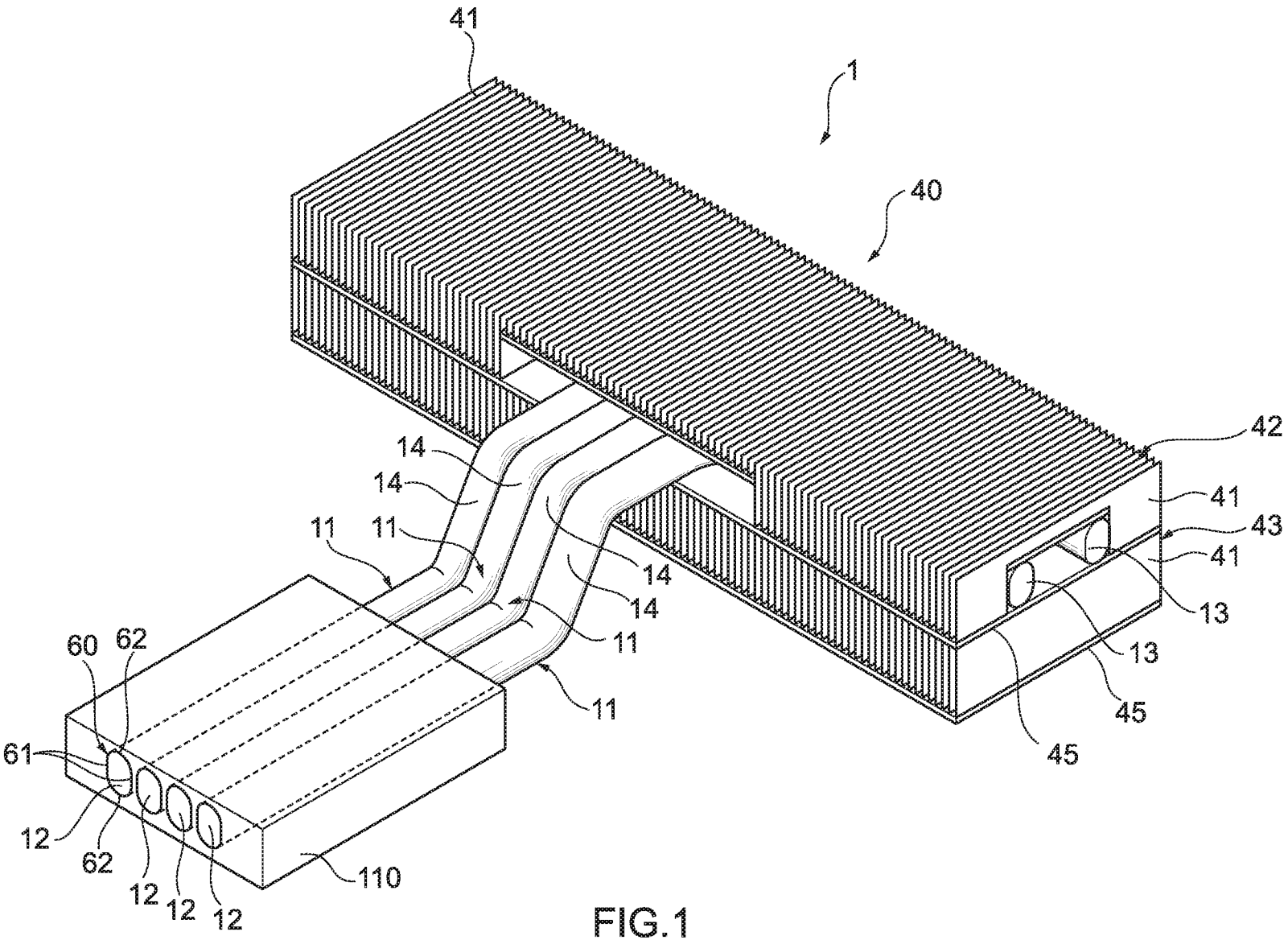
FIG. 1 is a perspective view of a heat sink according to a first embodiment of the present disclosure.
Figure 2:
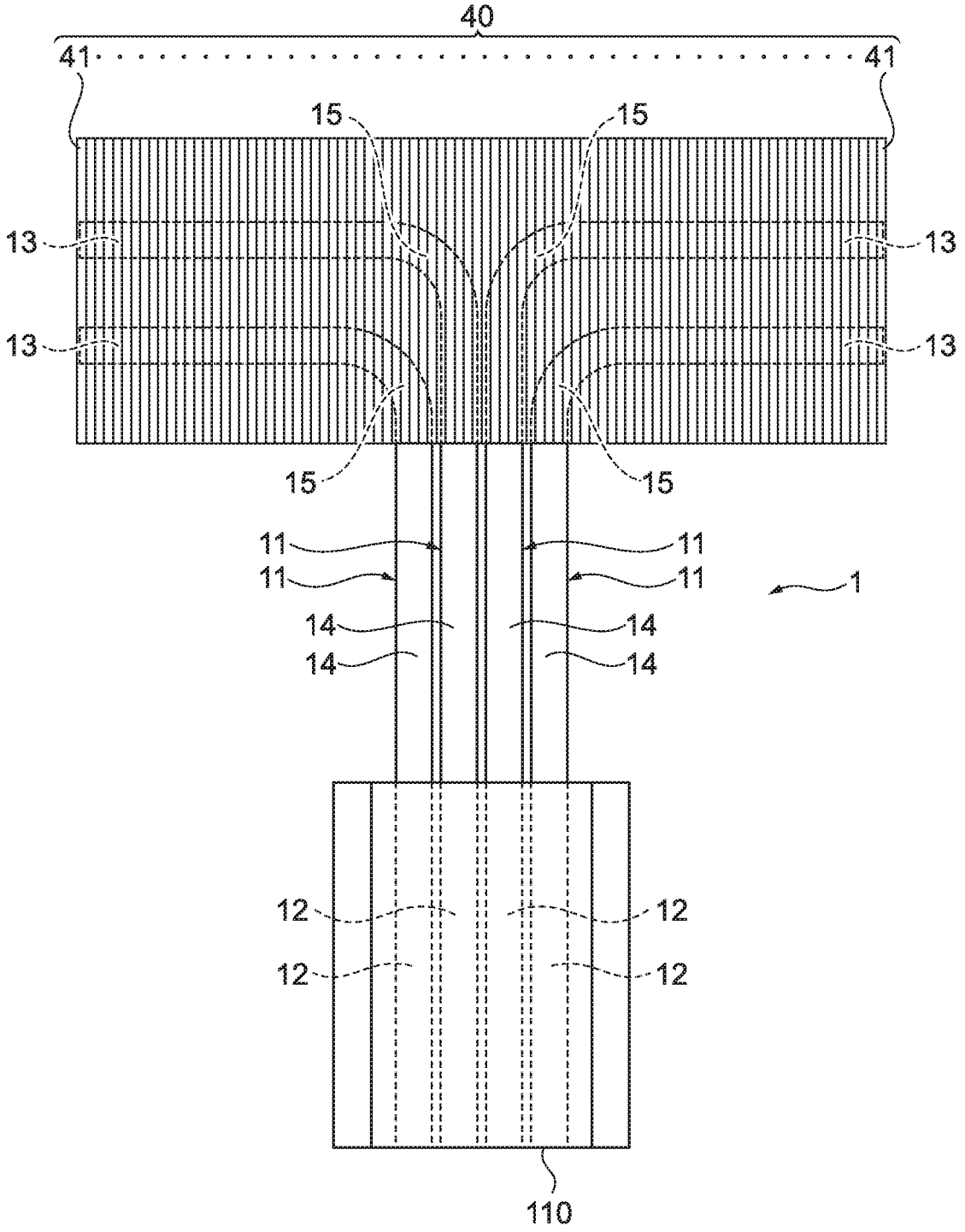
FIG. 2 is a plan view of the heat sink according to the first embodiment of the present disclosure.
Figure 3:
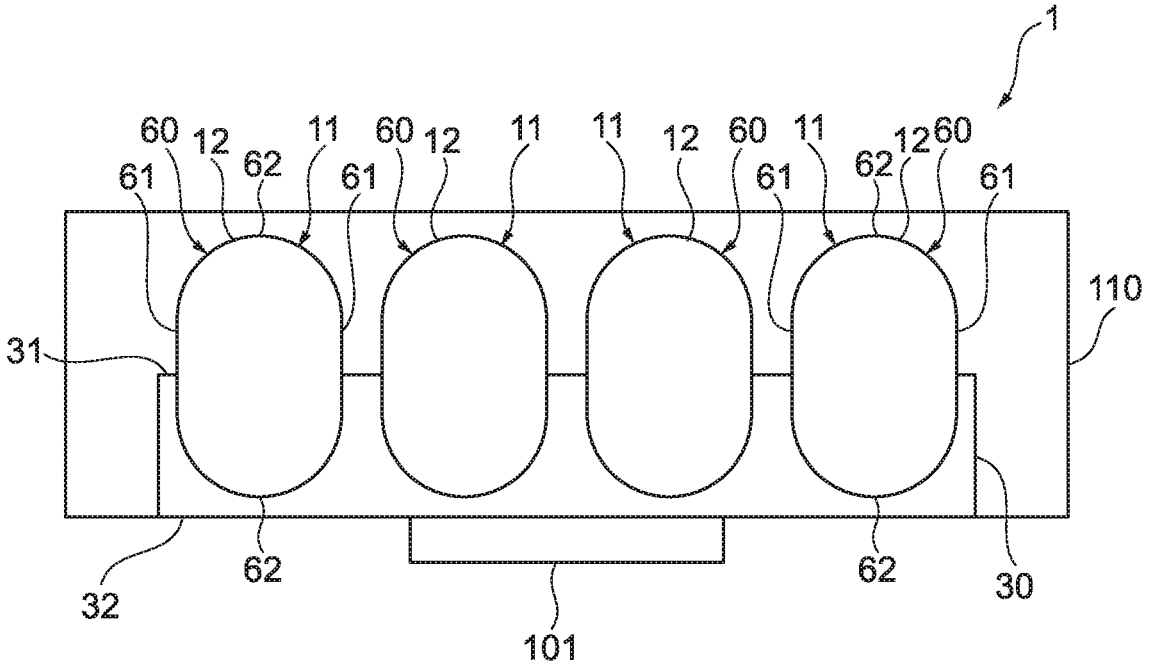
FIG. 3 is a side view of one end portion of the heat sink according to the first embodiment of the present disclosure.
Figure 4:
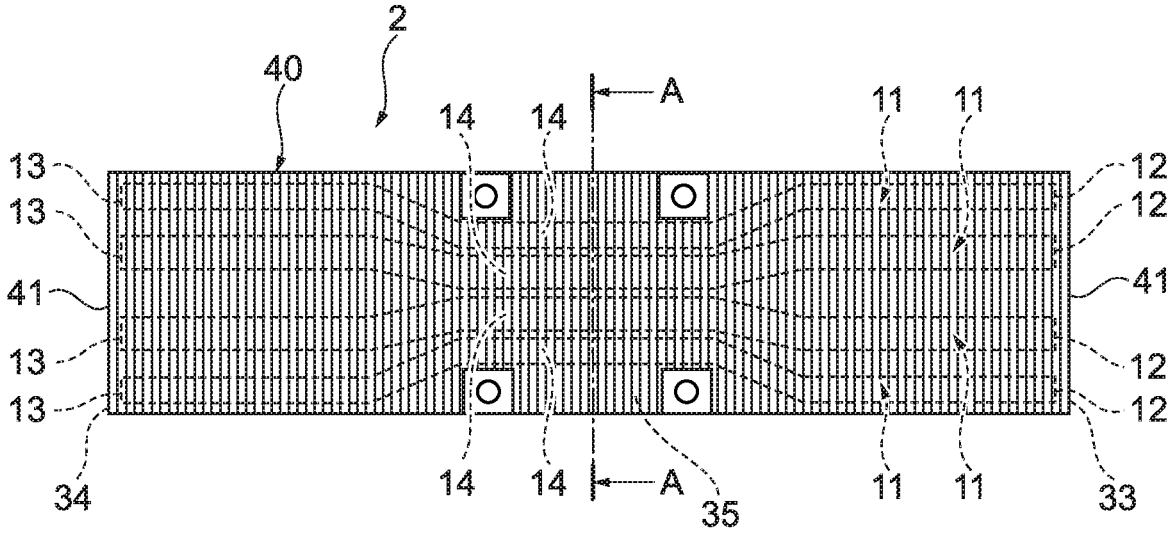
FIG. 4 is a plan view of a heat sink according to a second embodiment of the present disclosure.
Figure 5:
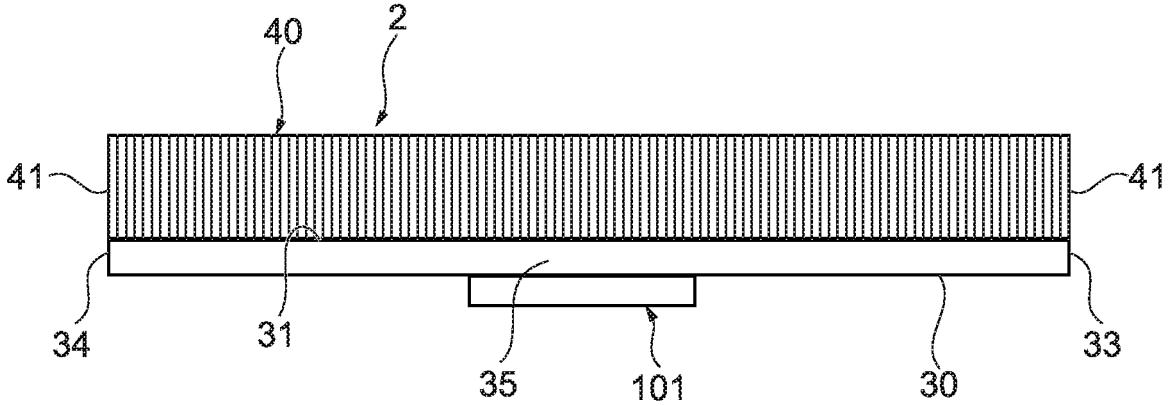
FIG. 5 is a side view of the heat sink according to the second embodiment of the present disclosure.
Figure 6:
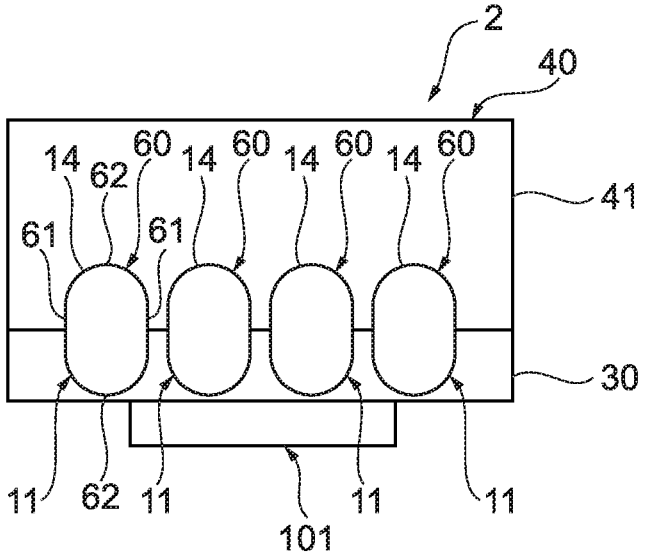
FIG. 6 is an explanatory view of a cross section A-A in FIG. 4 of the heat sink according to the second embodiment of the present disclosure.
Figure 7:
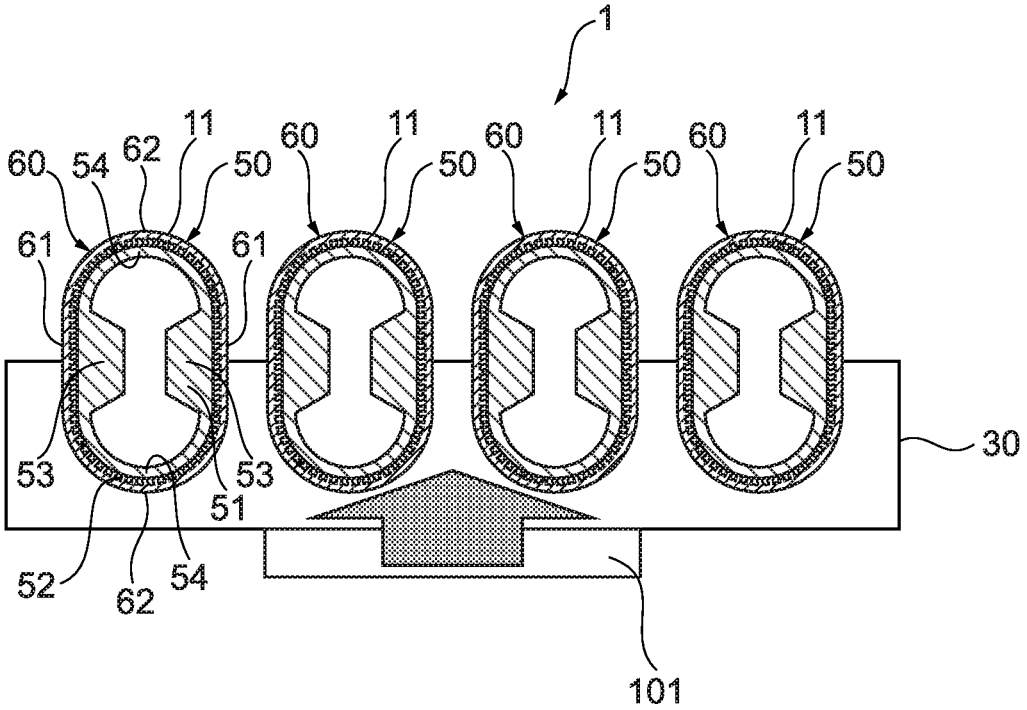
FIG. 7 is an explanatory view of a wick structure disposed in heat pipes provided to the heat sink according to the present disclosure.

Hereafter, a heat sink according to a first embodiment of the present disclosure will be described with reference to the drawings. FIG. 1 is a perspective view of the heat sink according to the first embodiment of the present disclosure. FIG. 2 is a plan view of the heat sink according to the first embodiment of the present disclosure. FIG. 3 is a side view of one end portion of the heat sink according to the first embodiment of the present disclosure. FIG. 4 is a plan view of a heat sink according to a second embodiment of the present disclosure. FIG. 5 is a side view of the heat sink according to the second embodiment of the present disclosure. FIG. 6 is an explanatory view of a cross section A-A in FIG. 4 of the heat sink according to the second embodiment of the present disclosure. FIG. 7 is an explanatory view of a wick structure disposed in heat pipes provided to the heat sink according to the present disclosure.

As illustrated in FIGS. 1 to 3, a heat sink 1 according to the first embodiment includes a plurality of heat pipes 11 thermally connected to a heating element 101 set as a cooling target of the heat sink 1, and a heat dissipation section 40. The plurality of heat pipes 11 are commonly thermally connected to the heat dissipation section 40. The heat dissipation section 40 has a plurality of heat dissipation fins 41. The heat pipe 11 is a heat transfer member having an internal space sealed and subjected to decompression treatment. A working fluid (not illustrated) is sealed in the internal space of the heat pipe 11.

In each of the plurality of heat pipes 11, one end portion 12 is thermally connected to the heating element 101, and another end portion 13 is thermally connected to the heat dissipation section 40. Therefore, in each of the plurality of heat pipes 11, the one end portion 12 functions as an evaporation section, and the other end portion 13 functions as a condensation section. In each of the plurality of heat pipes 11, a longitudinal direction linking the one end portion 12 to the other end portion 13 corresponds to a heat transfer direction. In the heat sink 1, a heat pipe group is formed in the plurality (four, in FIGS. 1 to 3) of heat pipes 11. In the heat pipe group, the respective heat pipes 11 are arranged in parallel in a side view. In the heat sink 1, the respective heat pipes 11 are arranged in parallel on a line in a side view. In addition, the evaporation sections of the plurality of heat pipes 11 are arranged in parallel along an extending direction of the heating element 101.

In each of the plurality of heat pipes 11, a cross sectional shape of the heat pipe 11 in a short direction, that is, a cross sectional shape in a direction orthogonal to the heat transfer direction of the heat pipe 11 is a flattened shape obtained by subjecting a circular shape to flattening process. That is, the heat pipe 11 has a flattened portion 60 whose cross sectional shape in the direction orthogonal to the heat transfer direction is flattened. In the heat sink of the present disclosure, in terms of space saving in a thermal connection portion with the heating element, it is sufficient when at least a part of the evaporation section in the heat pipe has the flattened portion, but in the heat pipe 11, the flattened portion 60 extends from the evaporation section corresponding to the one end portion 12 to the condensation section corresponding to the other end portion 13.

The flattened portion 60 includes mutually facing flat segments 61 forming a main surface, and mutually facing surfaces 62 linking the facing flat segments 61 in a thickness direction. The mutually facing flat segments 61 form a longitudinal direction of the flattened portion 60, and the mutually facing surfaces 62 in the thickness direction form the short direction of the flattened portion 60. In the flattened portion 60, one of the surfaces 62 in the thickness direction is arranged on a side of the heating element 101. In addition, the facing flat segments 61 adopt a mode of being erected. That is, the flattened portion 60 in the longitudinal direction adopts the mode of being erected. From the aforementioned description, the surfaces 62 in the thickness direction form a width direction of the heat pipe group.

Therefore, in the heat sink 1, an increased number of the heat pipes 11 can be thermally connected to the heating element 101 without increasing an installment space of a heat reception section of the heat sink 1 as compared with a heat pipe where a shape of the heat pipe in the short direction is circular.

As illustrated in FIG. 3, in the heat pipe 11, the one end portion 12 is thermally connected to a first surface 31 of a heat reception plate 30. The plurality of heat pipes 11 are all installed on the same surface of the heat reception plate 30. The heating element 101 is thermally connected to a second surface 32 corresponding to a surface on the opposite side of the first surface 31 of the heat reception plate 30. Therefore, each of the plurality of heat pipes 11 is thermally connected to the heating element 101 via the heat reception plate 30. It is noted that in the heat sink 1, a cover member 110 is attached to cover the heat reception plate 30 and an upper surface of the one end portion 12 of the heat pipe 11.

As illustrated in FIG. 7, a wick structure 51 configured to cause the liquid working fluid (not illustrated) to recirculate from the other end portion 13 to the one end portion 12 is disposed inside a container 50 of each of the heat pipes 11. The wick structure 51 is a structure having capillarity. A type and a shape of the wick structure 51 are not particularly limited. In the heat pipe 11, the wick structure 51 includes a first wick structure 52 corresponding to a plurality of fine grooves, a second wick structure 53 having a protrusion portion protruding from the inner surface of the container 50 in the flat segments 61 forming the main surface of the flattened portion 60 on an inner surface of the heat pipe 11, and a third wick structure 54 disposed in a layered manner on the surfaces 62 of the flattened portion 60 in the thickness direction on an inner surface of the container 50 of the heat pipe 11.

The first wick structure 52 is the plurality of fine grooves extending in the heat transfer direction on the inner surface of the container 50. In addition, the first wick structure 52 is formed in the entirety of the container 50 in a circumference direction. From the aforementioned description, the first wick structure 52 is formed in the entirety of the inner surface of the container 50.

The second wick structure 53 includes two protrusion portions protruding in a convex manner from the inner surface of the container 50. The second wick structure 53 is disposed on the first wick structure 52. In addition, the second wick structure 53 also protrudes relative to the third wick structure 54 disposed in a layered manner. That is, the second wick structure 53 has a wall thickness larger than that of the third wick structure 54. In addition, the two protrusion portions described above are arranged facing each other. The second wick structure 53 having the protrusion portions is excellent in recirculation property of the liquid working fluid as compared with the wick structures having no protrusion portions (the first wick structure 52 and the third wick structure 54 in the heat pipe 11). Therefore, since the liquid working fluid can be smoothly recirculated to the evaporation section corresponding to the flattened portion 60, even the heat pipe 11 having the flattened portion 60 in the evaporation section can exhibit the excellent heat transfer property. An area where the second wick structure 53 is disposed is not particularly limited, and can be selected depending on a use condition or the like of the heat sink 1, but in the heat sink 1, the second wick structure 53 extends from the one end portion 12 to the other end portion 13 of the heat pipe 11.

A type of the second wick structure 53 is a sintered body of metallic powder, a mesh formed of a metallic line, a metallic braided body, or the like, and is not particular limited, but in the heat pipe 11, a sintered body of metallic powder such as copper or a copper alloy is used.

The third wick structure 54 is formed at a substantially uniform thickness in a layered manner along the surfaces 62 of the flattened portion 60 in the thickness direction. In addition, the third wick structure 54 is formed to be continuous to the second wick structure 53 in a cross section in the direction orthogonal to the heat transfer direction of the heat pipe 11. The third wick structure 54 is disposed on the first wick structure 52. An area where the third wick structure 54 is disposed is not particularly limited, and can be selected depending on the use condition or the like of the heat sink 1, but in the heat sink 1, the third wick structure 54 extends from the one end portion 12 to the other end portion 13 of the heat pipe 11. It is noted that on the surfaces 62 of the flattened portion 60 in the thickness direction, since the capillarity of the first wick structure 52 contributes to the recirculation of the liquid working fluid to the evaporation section, a configuration may also be adopted where the third wick structure 54 is not disposed depending on the use condition or the like of the heat sink 1.

A type of the third wick structure 54 is a sintered body of metallic powder, a mesh formed of a metallic line, a metallic braided body, or the like, and is not particularly limited, but in the heat pipe 11, a sintered body of metallic powder such as copper or a copper alloy is used.

As illustrated in FIGS. 1 to 3, the one end portions 12 of the heat pipes 11 are arranged in parallel along the extending direction of the heating element 101. In addition, the one end portions 12 of the plurality of heat pipes 11 are arranged in parallel substantially on the same plane.

As illustrated in FIG. 2, a shape of the one end portion 12 of each of the plurality of heat pipes 11 in a plan view is substantially linear, and a shape of a central portion 14 located between the one end portion 12 and the other end portion 13 in a plan view is also substantially linear. Therefore, in the plurality of heat pipes 11, substantially linear parts in a plan view are arranged side by side from the one end portion 12 to the central portion 14.

In the heat sink 1, with regard to the heat pipe 11, a bent portion 15 is formed in the other end portion 13 thermally connected to the heat dissipation section 40. Therefore, each of the plurality of heat pipes 11 is substantially L-shaped in a plan view. In addition, the bent portion 15 of the heat pipe 11 located on a right side is bent in a right direction, and the bent portion 15 of the heat pipe 11 on a left side is bent in a left direction. In other words, bending directions of the bent portions 15 are opposite to each other with regard to the heat pipe 11 located on the left side and the heat pipe 11 located on the right side.

Each of the plurality of heat pipes 11 adopts a mode where the other end portion 13 extends in a substantially parallel direction to the longitudinal direction of the heat dissipation section 40 by the bent portion 15. In the heat dissipation section 40, the plurality of heat dissipation fins 41 are arranged in parallel such that a main surface (planar portion) of the heat dissipation fins 41 is arranged in a substantially parallel direction to the extending direction of the one end portion 12 of the heat pipe 11. The heat dissipation fins 41 are a thin flat plate-like member. In the heat sink 1, the other end portion 13 of the heat pipe 11 extending in the parallel direction to the longitudinal direction of the heat dissipation section 40 reaches an end portion of the heat dissipation section 40 in the longitudinal direction.

As illustrated in FIG. 1, an external shape of the heat dissipation section 40 is substantially cuboid. The heat dissipation section 40 adopts a structure where a first heat dissipation fin group 42 whose external shape is substantially cuboid, and a second heat dissipation fin group 43 whose external shape is substantially cuboid while being adjacent to the first heat dissipation fin group 42 are laminated. Both the first heat dissipation fin group 42 and the second heat dissipation fin group 43 adopt a structure where the plurality of heat dissipation fins 41 attached on a flat plate-like supporting body 45 are arranged in parallel in the substantially parallel direction to the longitudinal direction of the heat dissipation section 40.

The other end portion 13 of the heat pipe 11 is inserted between the first heat dissipation fin group 42 and the second heat dissipation fin group 43. When the other end portion 13 is arranged between the first heat dissipation fin group 42 and the second heat dissipation fin group 43, the heat dissipation section 40 is thermally connected to the heat pipe 11.

A material of the container 50 used in the heat pipe 11 is not particularly limited, and for example, copper, a copper alloy, aluminum, an aluminum alloy, stainless steel, and the like can be exemplified. In addition, the working fluid to be sealed in the container 50 can be appropriately selected according to compatibility with the material of the container 50, and for example, water, fluorocarbons, cyclopentane, ethylene glycol, a mixture of these, and the like can be exemplified. In addition, a material of the heat dissipation fins 41 is not particularly limited, and for example, a metal such as copper and a copper alloy can be exemplified.

Next, a use method example of the heat sink 1 according to the first embodiment will be described. As illustrated in FIG. 3, the heat pipe group of the heat sink 1 is installed such that the plurality of heat pipes 11 are arranged immediately above and in the vicinity of the heating element 101 on a plane on a side of the heat reception plate 30 of the heating element 101. The heat radiated from the heating element 101 is transmitted to the heat reception plate 30. The heat transmitted to the heat reception plate 30 is transmitted from the heat reception plate 30 to the one end portion 12 of the heat pipe 11. The heat transmitted to the one end portion 12 of the heat pipe 11 is transferred from the one end portion 12 of the heat pipe 11 to the other end portion 13 of the heat pipe 11 by a heat transfer action of the heat pipe 11. The heat transferred to the other end portion 13 of the heat pipe 11 is transmitted to the heat dissipation section 40 having the plurality of heat dissipation fins 41. When the heat transmitted to the heat dissipation section 40 is dissipated from the heat dissipation section 40 to an external environment, it is possible to cool the heating element 101.

At this time, the heat pipe 11 includes the flattened portion 60 whose cross sectional shape in the orthogonal direction to the heat transfer direction of the heat pipe 11 is flattened, and the surfaces 62 of the flattened portion 60 in the thickness direction are arranged facing the heating element 101, so that an increased number of the heat pipes 11 can be thermally connected to the heating element 101 set as the cooling target without increasing the installment space of the heat reception section of the heat sink 1. In addition, in the heat sink 1, in response to a state where an increased number of the heat pipes 11 can be thermally connected to the heating element 101, an increased number of the heat pipes 11 can be thermally connected to the heat dissipation section 40 of the heat sink 1, and a heat dissipation efficiency of the heat dissipation section 40 improves. Therefore, the heat sink 1 can exhibit the excellent cooling property for a heating element 101 even having a high heat value and being mounted to the narrowed space.

In addition, in the heat sink 1, since the evaporation sections of the plurality of heat pipes 11 (in the heat sink 1, the one end portions 12) are arranged in parallel along the extending direction of the heating element 101, it is possible to reliably and also easily thermally connect the plurality of heat pipes 11 to the heating element 101.

In addition, in the heat sink 1, since the evaporation section of the heat pipe 11 (in the heat sink 1, the one end portion 12) is thermally connected to the heat reception plate 30, the thermal connectivity between the heat pipe 11 and the heating element 101 improves. In addition, since the heat reception plate 30 also has an action as a heat equalizing plate configured to equalize thermal loads to the heat pipes 11 arranged in parallel, it is possible to more reliably exhibit the heat transfer property of the heat pipe 11.

Next, a heat sink according to a second embodiment of the present disclosure will be described with reference to the drawings. It is noted that with regard to the heat sink according to the second embodiment, since a main configuration is the same as that of the heat sink according to the first embodiment, the same components as those of the heat sink according to the first embodiment will be described by using the same reference signs.

In the heat sink 1 according to the first embodiment, the one end portion 12 of the first heat pipe 11 is thermally connected to the heat reception plate 30, but instead of this, as illustrated in FIGS. 4 and 5, the heat sink 2 according to the second embodiment adopts a mode where the heat pipe 11 from the one end portion 12 to the other end portion 13 extends from one end 33 to another end 34 of the heat reception plate 30. In addition, as illustrated in FIGS. 5 and 6, the heat pipe 11 is thermally connected to the first surface 31 of the heat reception plate 30.

The heat dissipation fins 41 are elected on the first surface 31 of the heat reception plate 30. In a heat sink 2, the heat dissipation fins 41 are elected on the first surface 31 of the heat reception plate 30 in a vertical direction. Edge portions of the heat dissipation fins 41 are attached on the first surface 31 of the heat reception plate 30. In addition, as the heat dissipation section 40, the plurality of heat dissipation fins 41 are arranged in parallel at a predetermined interval from the one end 33 to the other end 34 of the heat reception plate 30.

The heating element 101 is to be thermally connected to a central portion 35 of the heat reception plate 30 (that is, parts other than the one end 33 and the other end 34 of the heat reception plate 30). Therefore, the central portion 14 of the heat pipe 11 (that is, parts other than the one end portion 12 and the other end portion 13) is thermally connected to the heating element 101 to function as the evaporation section. In addition, both end portions (the one end portion 12 and the other end portion 13) of the heat pipe 11 are thermally connected to the heat dissipation section 40 to function as the condensation section.

It is noted that with regard to the heat sink 2, slight bending is formed in the heat pipe 11 such that the heat pipe 11 approaches the central portion in the orthogonal direction to the longitudinal direction of the heat pipe 11 in the central portion 35 of the heat reception plate 30. According to the mode described above, it is possible to improve the thermal connectivity between the heat pipe group and the heating element 101.

Also in the heat sink 2 where the heating element 101 is thermally connected to the central portion 14 of the heat pipe 11, the heat pipe 11 includes the flattened portion 60 whose cross sectional shape in the orthogonal direction to the heat transfer direction of the heat pipe 11 is flattened, and the surfaces 62 of the flattened portion 60 in the thickness direction are arranged facing the heating element 101. Thus, an increased number of the heat pipes 11 can be thermally connected to the heating element 101 without increasing the installment space of the heat reception section of the heat sink 2. In addition, also in the heat sink 2, in response to a state where an increased number of the heat pipes 11 can be thermally connected to the heating element 101, an increased number of the heat pipes 11 can be thermally connected to the heat dissipation section 40 of the heat sink 2, and the heat dissipation efficiency of the heat dissipation section 40 improves. Therefore, the heat sink 2 can also exhibit the excellent cooling property for the heating element 101 even having the high heat value and being mounted in the narrowed space.

Next, other embodiments of the present disclosure will be described. In the heat sink according to the first embodiment described above, the bent portion is formed in the other end portion of the heat pipe, and the heat pipe is substantially L-shaped in a plan view, but the shape of the heat pipe in a plan view is not particularly limited, and may be substantially linear, for example. In this case, the heat dissipation fins may be arranged in parallel such that the main surface (planar portion) of the heat dissipation fins is arranged in substantially orthogonal direction to the extending direction of one end portion of the heat pipe group.

The heat reception plate is disposed in the heat sink according to the first and second embodiments described above, but a configuration may be adopted where the heat reception plate is not disposed depending on a use situation of the heat sink. In addition, in the heat sink according to the first and second embodiments described above, the heat dissipation section is formed of the plurality of heat dissipation fins, but the mode of the heat dissipation section serving as a heat exchange unit is not particularly limited, and for example, a water cooling jacket and the like may also be used.

The heat sink of the present disclosure can be used in an extensive field, but for example, can be used in a field where a high performance electronic part is used such as a server used in a data center or the like since an excellent cooling performance can be exhibited for the heating element even having the high heat value and being mounted into the narrowed space.

What is claimed is:

1. A heat sink comprising: a plurality of heat pipes to be thermally connected to a heating element comprising an electronic component; and a heat dissipation section, comprising at least one fin, thermally connected to the plurality of heat pipes, wherein in the plurality of heat pipes, at least evaporation sections to be thermally connected to the heating element have flattened portions whose cross sectional shape in a direction orthogonal to a heat transfer direction of the plurality of heat pipes is flattened, and a surface in between the flattened portions of the heat pipe is arranged facing the heating element, the heat pipe has a longitudinal direction being vertical and a short direction being horizontal, wherein the flattened portions are located in the longitudinal vertical direction, only a part of a surface in the longitudinal direction of the flattened portion is embedded in a first surface of a heat reception plate, the heating element is thermally connected to a second surface corresponding to a surface on an opposite side of the first surface of the heat reception plate, the evaporation sections of the plurality of heat pipes are arranged apart from each other, the flattened portions of the plurality of heat pipes are arranged apart from each other and separated by the heat reception plate on the first surface of the heat reception plate, a cover member that is separate from the heat reception plate, the cover member covering the heat reception plate and the heat pipe, each of the heat pipes has a first wick structure corresponding to fine grooves formed on an inner surface of a container, a second wick structure and a third wick structure, the third wick structure is formed in a layered manner along the surfaces of the flattened portion in the short direction, the third wick structure is formed to be continuous to the second wick structure in a cross section in the direction orthogonal to the heat transfer direction of the heat pipe, the second wick structure has a wall thickness larger than that of the third wick structure and the second wick structure protrudes relative to the third wick structure disposed in a layered manner, two protrusion portions of the second wick structure are arranged facing each other, a material of the second wick structure is the same as a material of the third wick structure, the two protrusion portions of the second wick structure are spaced apart without contact, with flat surfaces of the second wick structures facing each other running parallel to each other and along the longitudinal direction, in an area where the second wick structure, which has a wall thickness larger than that of the third wick structure is present, the heat pipe has both portions that are not embedded in the heat reception plate and portions which are embedded in the heat reception plate such that the recirculation property of the liquid working fluid is increased, and heat equalized in the heat reception plate is transferred to the heat pipes at the area where the heat pipes are embedded in the heat reception plate.

2. The heat sink according to claim 1, wherein the evaporation section of the heat pipe is located in one end portion of the heat pipe, and a condensation section of the heat pipe to be thermally connected to the heat dissipation section is located in another end portion of the heat pipe.

3. The heat sink according to claim 1, wherein the evaporation sections of the plurality of heat pipes are arranged in parallel along an extending direction of the heating element.

4. The heat sink according to claim 2, wherein the evaporation sections of the plurality of heat pipes are arranged in parallel along an extending direction of the heating element.

5. The heat sink according to claim 1, wherein the evaporation section of the heat pipe is thermally connected to the heat reception plate, and the heat reception plate is to be thermally connected to the heating element.

6. The heat sink according to claim 2, wherein the evaporation section of the heat pipe is thermally connected to the heat reception plate, and the heat reception plate is to be thermally connected to the heating element.

7. The heat sink according to claim 3, wherein the evaporation section of the heat pipe is thermally connected to the heat reception plate, and the heat reception plate is to be thermally connected to the heating element.

8. The heat sink according to claim 1, wherein the flattened portion extends from the evaporation section to the condensation section.

9. The heat sink according to claim 2, wherein the flattened portion extends from the evaporation section to the condensation section.

10. The heat sink according to claim 3, wherein the flattened portion extends from the evaporation section to the condensation section.

11. The heat sink according to claim 5, wherein the flattened portion extends from the evaporation section to the condensation section.

12. The heat sink according to claim 1, wherein the second wick structure extends from one end portion to another end portion of the heat pipe, and the third wick structure extends from the one end portion to the other end portion of the heat pipe.

13. The heat sink according to claim 2, wherein the second wick structure extends from the one end portion to the other end portion of the heat pipe, and the third wick structure extends from the one end portion to the other end portion of the heat pipe.

14. The heat sink according to claim 3, wherein the second wick structure extends from one end portion to another end portion of the heat pipe, and the third wick structure extends from the one end portion to the other end portion of the heat pipe.

15. The heat sink according to claim 5, wherein the second wick structure extends from one end portion to another end portion of the heat pipe, and the third wick structure extends from the one end portion to the other end portion of the heat pipe.

16. The heat sink according to claim 1, wherein the cover member is configured to cover side surfaces and the first surface of the heat reception plate.

17. The heat sink according to claim 1, wherein only a part in the longitudinal direction of each of the two protrusion portions of the second wick structure is embedded in the heat reception plate.

* * * * *